United States Patent [19]

Breton

[11] 4,242,871

[45] Jan. 6, 1981

[54] LOUVER BURNER LINER

[75] Inventor: Robert A. Breton, Old Saybrook, Conn.

[73] Assignee: United Technologies Corporation, Hartford, Conn.

[21] Appl. No.: 76,639

[22] Filed: Sep. 18, 1979

[51] Int. Cl.[3] ..... F02C 7/22

[52] U.S. Cl. ..... 60/757

[58] Field of Search ..... 60/755, 756, 757, 754; 415/97 R; 165/134 R, DIG. 11

[56] References Cited

U.S. PATENT DOCUMENTS

| | | | |
|---|---|---|---|
| 2,573,694 | 11/1951 | De Zubay et al. | 60/757 |
| 3,420,058 | 1/1969 | Howald et al. | 60/757 |
| 3,737,152 | 6/1973 | Wilson | 60/757 |

FOREIGN PATENT DOCUMENTS

| | | | |
|---|---|---|---|
| 1270889 | 6/1968 | Fed. Rep. of Germany | 60/757 |

*Primary Examiner*—Robert E. Garrett

*Attorney, Agent, or Firm*—Norman Friedland

[57] ABSTRACT

A burner for a gas turbine power plant is constructed by machining a louver configuration having a series of slots communicating with the surrounding cooling air into the combustion chamber for providing film cooling adjacent the downstream wall of the louver, a series of apertures for preventing recirculation of the hot combustion gases into the wakes formed when the cool air passes through the slots and another series of holes and variable wall thickness to control temperature gradient in the high thermal stress zones.

4 Claims, 5 Drawing Figures

LOUVER BURNER LINER

BACKGROUND OF THE INVENTION

This invention relates to burners for gas turbine power plants and particularly to the construction thereof including means for eliminating the lip of conventional louver type burners without impairing its cooling capabilities.

As is well known in combustor technology the lip of the louver in a burner is its most vulnerable portion necessitating the highest percentage of maintenance relative to the entire combustor. Conventionally, the burner is fabricated from sheet metal joined to form a louver configuration with an extending lip. In recent years some effort has been employed to fabricate the burners by machining stock material into the burner configuration. Exemplary of a machined louvered burner is U.S. Pat. No. 3,373,152 granted to J. D. Wilson on June 5, 1973. The louvered construction of the burner described in the above-mentioned patent shows a conical intermediate portion having a plurality of drilled holes that have a prescribed dimension. The purpose of the drilled holes is to coalesce the airstream to form a film over the hot surfaces for cooling the same.

A disadvantage of the circular hole construction of the above-mentioned patent is that it has a consequential limitation on the amount of cooling air that can be employed. This patent, supra, does not recognize that both the cooling and structural aspects can be considered in order to control the temperature gradients so as to minimize thermally induced stresses.

In another area of differences, and in accordance with the teachings of this invention, the array of holes and slots are judiciously selected to not only provide the necessary film of cooling air to cool the burner liner but to also control the temperature across the elbow portion of the liner and provide hole configuration to prevent hot gas recirculation which would otherwise reduce the effectiveness of the cooling film.

Also, in accordance with the teachings of this invention, the wall thickness of the liner is varied so as to minimize stress concentrations and minimize louver stresses and this aspect is combined with judiciously sized and located cooling holes to control the temperature gradient so as to minimize thermally induced stresses.

SUMMARY OF THE INVENTION

An object of this invention is to provide for a gas turbine engine, an improved combustor liner. A feature is to fabricate the liner so that both the thickness of the walls of the liner is varied and holes and slots are judiciously sized and located to control the thermal gradient at discrete locations. Another feature is to also provide film cooling and prevent gas recirculations by providing an improved hole and slot configuration in the liner.

Other features and advantages will be apparent from the specification and claims and from the accompanying drawings which illustrate an embodiment of the invention.

DESCRIPTION OF THE PREFERRED EMBODIMENT

A typical louver constructed burner fabricated from sheet metal is described in U.S. Pat. No. 4,077,205 granted to F. C. Pane and D. Sepulveda on Mar. 7, 1978 and assigned to the same assignee as this patent application and is incorporated herein by reference. A machined liner is disclosed in U.S. Pat. No. 3,737,152 and is also incorporated herein by reference.

Figure 1:
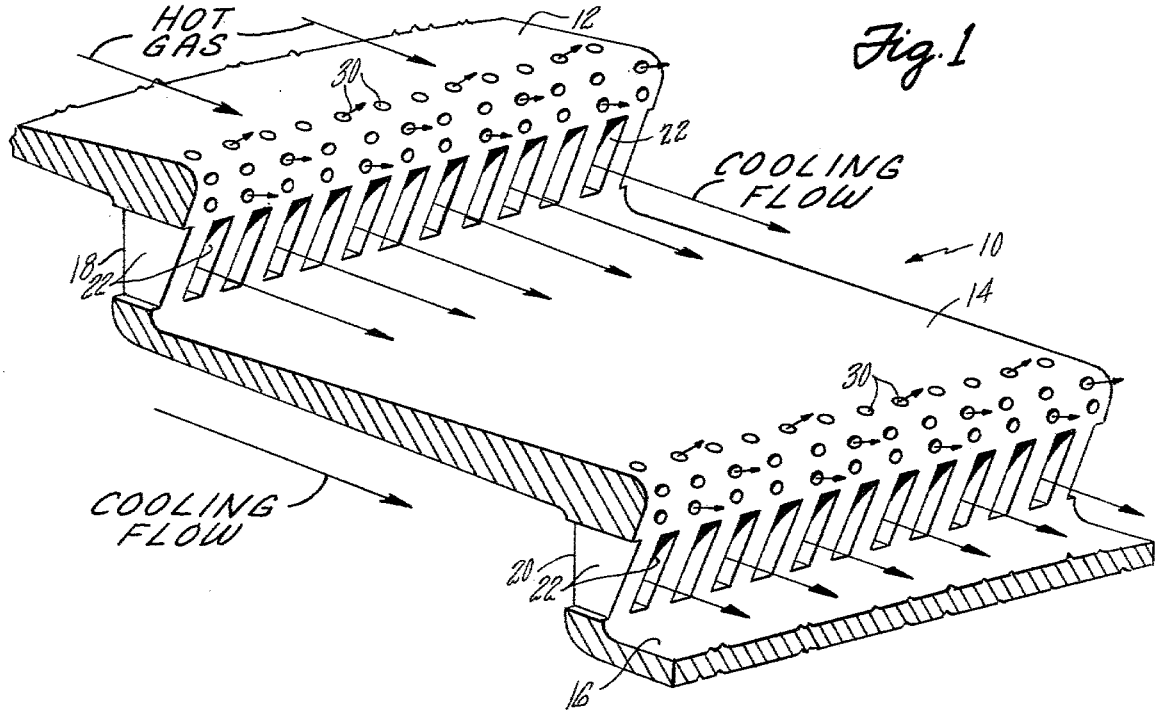
FIG. 1 is a partial view in perspective illustrating the details of this invention.

Although it is contemplated in the preferred embodiment that the lipless type of burner forming a part of this invention is fabricated from metal that is machined to the designed configuration, for the sake of convenience and simplicity, only that portion of the liner that would enable one skilled in the art to practice the invention is shown. As shown in FIG. 1, the liner generally indicated by reference numeral 10 is configured into concentric sections 12, 14 and 16 spaced by the stepped or bent sections 18 and 20 depending relatively vertical therebetween. The hot gases from the combustion zone flows over the top portion as illustrated in this embodiment and the cooling air essentially flows under the under portion. In reality, the hot gases are in the inner diameter and the cooling air surrounds the outer diameter of the burner liner and although appears like flat surfaces, they are circular through the transverse axis.

According to this invention, the liner is fabricated to provide means for cooling the liner so as to accommodate the extreme temperature to which it is exposed. Vertical slots 22 are formed in the bent portion and are closely spaced so that the rapidly diffusing film joins the layer of cooling air passing over the top surface of the liner while preventing hot gases from recirculating into the cooling air diffusion zone.

Inasmuch as a high incidence of failure is evidenced at the bend, the liner is designed so that it is thickest at the bent portion where a plurality of holes 30 are drilled therein so that the combination of the varying thickness and cooling holes serve to control the temperature gradient across the bent portion of the liner. This minimizes thermally induced stresses and increases the life of the liner. The process selection of slot and hole sizes permits a great deal of latitude in cooling capacity for selecting the cooling desired for a particular application.

Figure 2:
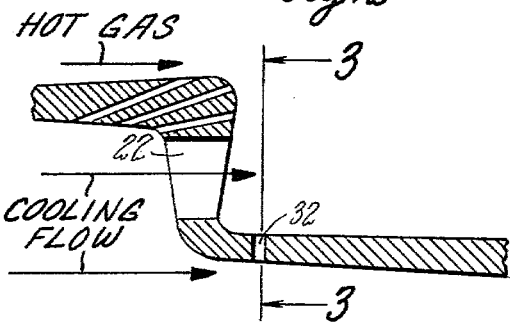
FIG. 2 is a sectional view of a slightly modified embodiment of FIG. 1.
Figure 3:
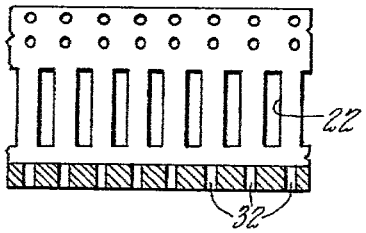
FIG. 3 is a sectional view of FIG. 2 taken along lines 3—3.

FIGS. 2 and 3 show identical structure as that shown in FIG. 1 except for the inclusion of holes 32 spaced transverse to the direction of flow for admitting cooling air perpendicular to the flow discharging from slots 22 and are aligned with the wakes formed downstream thereof. This serves to prevent the recirculation of the hot gases.

Figure 4:
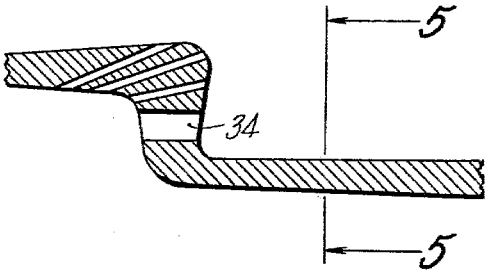
FIG. 4 is a sectional view showing another embodiment of this invention.
Figure 5:
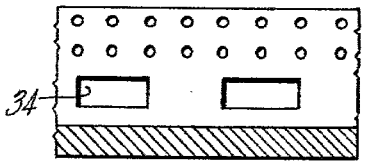
FIG. 5 is a sectional view taken along lines 5—5 of FIG. 4.

FIGS. 4 and 5 are a similar construction to the one shown in FIG. 1 where the slots 34 in FIG. 4 are made horizontal rather than vertical.

It should be understood that the invention is not limited to the particular embodiments shown and described herein, but that various changes and modifications may be made without departing from the spirit and scope of this novel concept as defined by the following claims.

I claim:

1. A burner liner for a combustor for a gas turbine power plant having wall means defining a chamber in which combustion takes place, said wall means having substantially step like portions including an upper portion and a lower portion and a substantially vertical portion therebetween, a plurality of spaced vertical slots, the space therebetween being sized to allow a portion of the cooling air flowing over the upper and lower portions to pass therethrough and forming a film of cooling air to pass adjacent one of said portions in the combustion side of said wall means, a plurality of drilled holes adjacent said slots and at the bent portion formed at the juncture point of said upper portion and said vertical portion also admitting cooling air and the thickness therebetween of said wall means being selected to control the temperature gradient across said vertical portion.

2. A burner liner as in claim 1 including a plurality of laterally spaced apertures in said lower portion adjacent said vertical slots to admit cooling air to flow adjacent the wake created by the flow passing through said vertical slots to prevent recirculation of the hot gases in said combustion chamber.

3. A burner liner for a combustor for a gas turbine power plant having wall means defining a chamber in which combustion takes place, said wall means having substantially step like portions including an upper portion and a lower portion and a substantially vertical portion therebetween, a plurality of laterally spaced horizontal slots, the space therebetween being sized to allow a portion of the cooling air flowing over the upper and lower portions to pass through said horizontal slots forming a film of cooling air to pass adjacent one of said portions in the combustion side of said wall means, a plurality of drilled holes adjacent said horizontal slots and at the bent portion formed at the juncture point of said upper portion and said vertical portion also admitting cooling air into said combustion zone cooling said juncture point, said cooling effect and the thickness of said bent portion of said wall means being varied to select a given temperature gradient across said vertical portion.

4. A burner liner as in claim 3 including a plurality of laterally spaced apertures in said lower portion adjacent said horizontal slots to admit cooling air to flow adjacent the wake created by the flow passing through said horizontal slots to prevent recirculation of the hot gases in said combustion chamber.

* * * * *